US011435098B2

(12) United States Patent
Naughton

(10) Patent No.: US 11,435,098 B2
(45) Date of Patent: Sep. 6, 2022

(54) SYSTEM AND METHOD FOR ACCESS CONTROL USING DIFFERENTIAL AIR PRESSURE

(71) Applicant: JOHNSON CONTROLS TYCO IP HOLDINGS LLP, Milwaukee, WI (US)

(72) Inventor: Thomas P. Naughton, Groton, MA (US)

(73) Assignee: JOHNSON CONTROLS TYCO IP HOLDINGS LLP, Milwaukee, WI (US)

( * ) Notice: Subject to any disclaimer, the term of this patent is extended or adjusted under 35 U.S.C. 154(b) by 621 days.

(21) Appl. No.: 16/355,305

(22) Filed: Mar. 15, 2019

(65) Prior Publication Data

US 2020/0292187 A1 Sep. 17, 2020

(51) Int. Cl.

| | |
|---|---|
| ***F24F 11/00*** | (2018.01) |
| ***F24F 11/72*** | (2018.01) |
| ***F24F 11/35*** | (2018.01) |
| ***F24F 110/40*** | (2018.01) |

(52) U.S. Cl.

CPC ..... *F24F 11/0001* (2013.01); *F24F 11/35* (2018.01); *F24F 11/72* (2018.01); *E05Y 2900/132* (2013.01); *F24F 2011/0004* (2013.01); *F24F 2110/40* (2018.01); *F24F 2221/56* (2013.01)

(58) Field of Classification Search

CPC ..... F24F 11/0001; F24F 11/35; F24F 11/72; F24F 2011/0004; F24F 2110/40; F24F 2221/56; E05Y 2900/132

USPC ..... 454/238

See application file for complete search history.

(56) References Cited

U.S. PATENT DOCUMENTS 4,485,729 A * 12/1984 Crittenden ..... B01L 1/04 454/238
4,765,352 A * 8/1988 Strieter ..... B08B 15/026 134/104.4
4,773,311 A * 9/1988 Sharp ..... B08B 15/023 454/56
5,205,783 A * 4/1993 Dieckert ..... B08B 15/023 454/238

(Continued)

FOREIGN PATENT DOCUMENTS

CA 2805261 A1 * 2/2012 ..... E05F 15/40

*Primary Examiner* — Edelmira Bosques
*Assistant Examiner* — Frances F. Hamilton
(74) *Attorney, Agent, or Firm* — ArentFox Schiff LLP

(57) ABSTRACT

An access control system receives a trigger command for controlling a ventilation system; determines that the trigger command includes a lock trigger to hold an entrance door in a closed position; and induces a locking differential air pressure between opposite sides of the entrance door in response to the lock trigger, where the locking differential air pressure is sufficient to bias the entrance door to contact or to increase contact with a door frame in the closed position. The access control system may also determine that the trigger command includes an open assist trigger to ease an opening of the entrance door; and may induce an opening differential air pressure between the opposite sides of the entrance door in response to the open assist trigger, where the opening differential air pressure is sufficient to bias the entrance door to reduce contact with the door frame in the closed position.

19 Claims, 8 Drawing Sheets

(56) References Cited

U.S. PATENT DOCUMENTS

| | | | | | |
|---|---|---|---|---|---|
| 5,360,372 | A * | 11/1994 | Newman | A62B 3/00 | 454/195 |
| 5,538,471 | A * | 7/1996 | Guiles, Jr. | F24F 11/77 | 454/238 |
| 5,545,086 | A * | 8/1996 | Sharp | F24F 11/0001 | 454/238 |
| 5,718,627 | A * | 2/1998 | Wicks | F24F 11/0001 | 454/68 |
| 6,790,136 | B2 * | 9/2004 | Sharp | F24F 11/0001 | 454/229 |
| 9,581,347 | B2 * | 2/2017 | Fiorita, Jr. | B01L 1/04 | |
| 10,492,970 | B2 * | 12/2019 | Merino | A61G 9/00 | |
| RE48,081 | E * | 7/2020 | Donohue | F24F 11/74 | |
| 10,794,605 | B2 * | 10/2020 | Coogan | F24F 11/30 | |
| 2007/0207724 | A1 * | 9/2007 | Coogan | G05D 16/208 | 454/238 |
| 2012/0058717 | A1 * | 3/2012 | Wiche | F24F 11/77 | 454/238 |
| 2013/0005236 | A1 * | 1/2013 | Kim | F24F 11/30 | 454/238 |
| 2014/0124057 | A1 * | 5/2014 | Freund | G01F 1/34 | 702/47 |
| 2019/0314653 | A1 * | 10/2019 | Royle | A62B 3/00 | |

* cited by examiner

SYSTEM AND METHOD FOR ACCESS CONTROL USING DIFFERENTIAL AIR PRESSURE

BACKGROUND

The present disclosure relates generally to access control.

Emergency access control in a building is commonly implemented by remotely and/or centrally controlling individual locks on entrance doors/windows. Applications of emergency access control are, for example, activating a security lock-down in a "missing patient" or an "active shooter" situation.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

The present disclosure provides systems, apparatuses, and methods for using differential air pressure for access control.

In an aspect, an access control method includes receiving a trigger command for controlling a ventilation system; determining that the trigger command comprises a lock trigger to hold an entrance door in a closed position; and inducing a locking differential air pressure between opposite sides of the entrance door in response to the lock trigger, wherein the locking differential air pressure is sufficient to bias the entrance door to contact or to increase contact with a door frame in the closed position.

In a further aspect, an apparatus for access control may include a memory comprising instructions; and a processor in communication with the memory and configured to execute the instructions to: receive a trigger command for controlling a ventilation system; determine that the trigger command comprises a lock trigger to hold an entrance door in a closed position; and induce a locking differential air pressure between opposite sides of the entrance door in response to the lock trigger, wherein the locking differential air pressure is sufficient to bias the entrance door to contact or to increase contact with a door frame in the closed position.

In yet another aspect, a non-transitory computer-readable medium may store instructions that, when executed by a processor, cause the processor to: receive a trigger command for controlling a ventilation system; determine that the trigger command comprises a lock trigger to hold an entrance door in a closed position; and induce a locking differential air pressure between opposite sides of the entrance door in response to the lock trigger, wherein the locking differential air pressure is sufficient to bias the entrance door to contact or to increase contact with a door frame in the closed position.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components may be shown in block diagram form in order to avoid obscuring such concepts.

Aspects of the present disclosure provide methods, apparatuses, and systems for providing or supplementing access control functionality for an entrance door by inducing a differential air pressure between opposite sides of the door in a closed or at least substantially closed position, so as to cause the differential air pressure to exert a force on the door to keep the door closed or to push the door open, whichever is desired. In an aspect, for example, the access control system of a building may work in conjunction with a ventilation system of the building, e.g., a heating, ventilation, and air conditioning (HVAC) system, to replace or supplement the functionality of door locks by varying the relative air pressure on opposite sides of each door to secure each door in a closed position or to assist in the opening of each door, as needed. In some alternative and/or additional aspects, other localized or centralized air movement devices may be used in place of or in conjunction with the ventilation system to provide the aforementioned access control functionality.

Turning now to the figures, example aspects are depicted with reference to one or more components described herein, where components in dashed lines may be optional.

Figure 1:
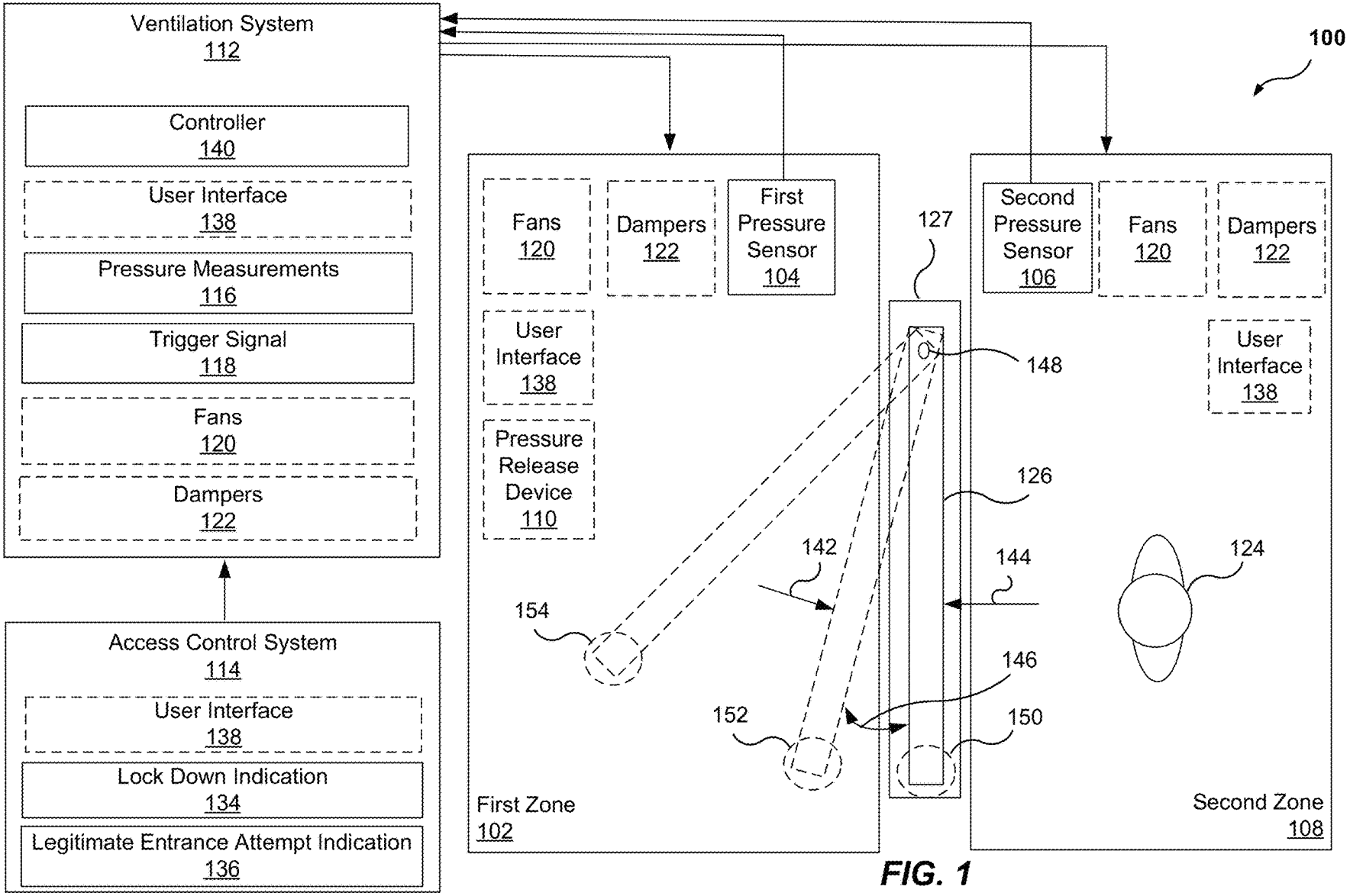
FIG. 1 is a schematic diagram of a first example access control system using differential air pressure.

Referring to FIG. 1, in one non-limiting aspect, a ventilation system 112 may provide or may supplement access control functionality across a building 100 by controlling the relative air pressure between neighboring zones in the building 100, such as a first zone 102 and a second zone 108 defined on opposite sides of a door 126. For example, the ventilation system 112 may cause a differential air pressure between opposite sides of the door 126 so as to press the door 126 against a corresponding door frame 127, e.g., to apply a force to the door 126 to hold it closed against the door frame 127. Specifically, in one example, the door 126 may be rotatable about an axis 148 and along a rotational direction 146 to open toward the first zone 102 and to close toward the second zone 108. When the door 126 is in the closed position 150 or in the at least substantially closed position 152, the ventilation system 112 may induce a higher air pressure in the first zone 102 as compared to the second zone 108 so as to cause a closing force 142 that pushes the door 126 toward the door frame 127. It should be understood that, in some implementations, the door 126 may be a sliding door, e.g., that moves in parallel to the door opening between open and closed positions. In this case, the differential air pressure may apply the force normal to the direction of movement of the door 126 to hold the door 126 against the door frame 127, such as in the closed position, and prevent the sliding movement of the door 126.

Alternatively, the ventilation system 112 may cause a differential air pressure between opposite sides of the door 126 so as to assist in opening the door 126 by pushing the door 126 away from the door frame 127. Specifically, when the door 126 is in the closed position 150 or in the at least substantially closed position 152, the ventilation system 112 may cause the air pressure in the first zone 102 to be lower than the second zone 108 so as to cause an opening force 144 that pushes the door 126 away from the door frame 127. However, when the door 126 is in a not-substantially-closed position 154 where the gap between the door 126 and the door frame 127 allows for the air pressure on the two sides of the door 126 to equalize, the ventilation system 112 may not be able to and may not attempt to induce a differential air pressure on opposite sides of the door 126. In an aspect, a mechanism, such as an electrically activated lever, may be implemented to at least substantially close the door 126 before activating the access control functionality of the ventilation system 112.

In an aspect, the ventilation system 112 may provide access control functionality for the door 126 by controlling one or more fans 120 and/or dampers 122 located at the first zone 102 and/or at the second zone 108 to induce an appropriate differential air pressure between the opposite sides of the door 126. Alternatively, the fans 120 and/or dampers 122 may be external to the zones 102 and 108 but fluidly coupled to the zones 102 and 108 via ducting.

In an aspect, the ventilation system 112 may include an HVAC system. In an aspect, the building 100 may be an office building including different areas/zones such as offices, hallways, bathrooms, closets, outdoor, etc., and may include doors in between adjacent areas/zones. In an aspect, the ventilation system 112 may identify at least two different zones on opposite sides of at least one door. For example, for a building floor, the ventilation system 112 may identify a plurality of zones on opposite sides of a plurality of doors. Further details of these aspects are described below with reference to FIG. 2.

Still referring to FIG. 1, in an aspect, for example, the zones 102 and 108 may be defined at the time of the installation of the ventilation system 112. In some cases, however, at least one of the zones 102 and 108 may not be controlled by the ventilation system 112. For example, the first zone 102 may correspond to the area outside the building 100 with an ambient air pressure. In this case, the ventilation system 112 may only control the air pressure in the second zone 108 to induce a desired differential air pressure between the opposite sides of the door 126. For example, the ventilation system 112 may induce an air pressure in the second zone 108 that is higher than the ambient air pressure in the first zone 102, so as to cause the opening force 144 on the door 126. Alternatively, the ventilation system 112 may induce an air pressure in the second zone 108 that is lower than the ambient air pressure in the first zone 102, so as to cause the closing force 142 on the door 126. In these aspects, although the ventilation system 112 does not control the air pressure in the first zone 102, the ventilation system 112 may still receive ambient air pressure measurements 116 from the first pressure sensor 104 positioned outside the building and in the first zone 102.

In an aspect, the building 100 may also be controlled by an access control system 114 that controls the building entrance doors including the door 126. In this case, by varying/inducing small air pressure differentials in adjacent zones such as the first zone 102 and the second zone 108, the ventilation system 112 may work in conjunction with the access control system 114 to secure or open doors such as the door 126. Accordingly, the ventilation system 112 may provide alternative or supplemental access control functionality to the access control system 114.

In an aspect, the ventilation system 112 may be configured with at least two different operating modes having corresponding target differential air pressures defined for neighboring zones such as the first zone 102 and the second zone 108. In an aspect, the operating modes may include, for example, a normal mode where the air pressure on opposite sides of the doors are equalized, a lock mode where the ventilation system 112 induces a differential air pressure on opposite sides of at least one door to exert a positive pressure to close the door, and an open assist mode where the ventilation system 112 induces a differential air pressure on opposite sides of at least one door to exert a positive pressure to assist in opening the door.

In an aspect, the access control functionality of the ventilation system 112 may be implemented by a controller 140 in response to receiving a trigger signal 118 corresponding to one of the aforementioned modes, such as an "Equalize" trigger, an "Open Assist" trigger, and a "Lock Down" trigger. Upon receiving the trigger signal 118, the controller 140 may discern the mode that the trigger signal 118 corresponds to, and may then control the ventilation system 112 to achieve a desired target differential air pressure between adjacent zones. After achieving the desired target air pressure differential, the controller 140 may further control the ventilation system 112 to maintain the desired target differential air pressure between adjacent zones until a further trigger signal 118 is received to switch to a different mode of operation, e.g., to switch to the normal mode after implementing a lock down.

In an aspect, for example, the trigger signal 118 may be provided through a user interface 138 of the ventilation system 112. Alternatively, the trigger signal 118 may be provided through a user interface 138 of the access control system 114 or through a user interface 138 located at the first zone 102 or at the second zone 108. For example, a user 124 located at the second zone 108 may use a user interface 138 located at the second zone 108 to provide a "legitimate entrance attempt indication" 136 to the access control system 114. Alternatively and/or additionally, the user 124 may provide proper credentials, e.g., a password, a fingerprint, a voice command, etc., through the user interface 138 located at the second zone 108. In response, the access control system 114 may provide an "Open Assist" trigger signal 118 to the ventilation system 112 to induce a differential air pressure that causes the opening force 144 on the door 126. For example, if the second zone 108 corresponds to the outside of the building 100, the ventilation system 112 may induce an air pressure in the first zone 102 that is lower than the ambient air pressure, thus pushing the door 126 to open toward the first zone 102.

Alternatively, a "lock down indication" 134 may be received through a user interface 138 of the access control system 114 or any other input device configured for activating a "Lock Down" such as a button at the reception desk. For example, an operator or attendant of the access control system 113 may provide a "lock down indication" 134 through a user interface 138 of the access control system 114. In response, the access control system 114 may provide a "Lock Down" trigger signal 118 to the ventilation system 112 to induce a differential air pressure that causes the closing force 142 on the door 126.

In alternative and/or additional aspects, the trigger signal 118 may be automatically generated by the access control system 114 and/or by the ventilation system 112. For example, the access control system 114 may generate the "legitimate entrance attempt indication" 136 upon identifying, e.g., via security cameras or via a wirelessly-transmitting personal identifier of the user 124, that the user 124 is legitimate and is approaching the door 126 from the second zone 108. In response, the access control system 114 may provide the "Open Assist" trigger signal 118 to the ventilation system 112 to induce a differential air pressure that causes the opening force 144 on the door 126. As another example, the access control system 114 may generate the "lock down indication" 134 upon identifying a threat or any other crisis mode. For example, the access control system 114 may identify, for example, via security cameras, that the user 124 in the second zone 108 is hostile, e.g., by identifying via image processing that the user 124 is carrying a gun. In response, the access control system 114 may provide the "Lock Down" trigger signal 118 to the ventilation system 112 to induce a differential air pressure that causes the closing force 142 on the door 126.

In an aspect, a pressure release device 110 may be located in the first zone 102 and/or in the second zone 108, and may be configured to allow for an air pathway between the first zone 102 and the second zone 108 to equalize the air pressure on the opposite sides of the door 126 and thereby eliminate the opening force 144 and/or the closing force 142 to override the access control functionality of the ventilation system 112. In an aspect, the pressure release device 110 may have a structure that can withstand the differential air pressure between the first zone 102 and the second zone 108, but can be broken or opened to equalize the air pressure between the first zone 102 and the second zone 108. For example, the pressure release device 110 may include a breakable glass panel, a valve, etc.

In an aspect, the force exerted on the door 126 by the differential air pressure induced on opposite sides of the door 126 may be derived as:

Force (lbs.)=Door Area (Square Inches)*Differential Air Pressure (PSI) where PSI stands for "pounds per square inch." In an aspect, for example, the door 126 may be an average "7 feet" tall by "3 feet" wide door, thus providing a "3024 square inches" surface area on each side. In this case, if the ventilation system 112 induces and maintains a "0.1 PSI" differential air pressure between the first zone 102 and the second zone 108, such a differential air pressure would exert a force on the door 126 that is proportional to the surface area of the door 126:

3024 square inches*0.1 PSI=302.4 lbs.

Such a force of "302.4 lbs." will be distributed uniformly across the surface area of the door 126, and may be about the same as a maglock's holding force on a glass door. Alternatively, if the door 126 is a small "7 feet" tall by "30 inches" wide door providing a "2520 square inches" surface area, the force exerted on the door 126 by a "0.1 PSI" differential air pressure between the first zone 102 and the second zone 108 is:

2520 square inches*0.1 PSI=252 lbs.

In an aspect, the differential air pressure between the first zone 102 and the second zone 108 may be created by adjusting the speed/velocity and/or volume of air flow going to the first zone 102 and/or the second zone 108 as compared to each other. For example, the ventilation system 112 may change the velocity of one or more fans 120 to control how much air is moving through the first zone 102 and/or the second zone 108, or may adjust a barrier, e.g., may adjust one or more dampers 122, to restrict the air flowing through the first zone 102 and/or the second zone 108. In an aspect, for example, the controller 140 of the ventilation system 112 may determine which one of the first zone 102 or the second zone 108 should have a higher pressure, and then adjust one or more fans 120 or dampers 122 accordingly.

In an aspect, the controller 140 may receive pressure measurements 116 from at least one pressure sensor, e.g., a first pressure sensor 104 in the first zone 102 and/or a second pressure sensor 106 in the second zone 108, and use the pressure measurements 116 to adjust one or more fans 120 and/or dampers 122 to achieve and/or maintain a desired differential air pressure between opposite sides of the door 126 in the first zone 102 and the second zone 108.

In an aspect, the door 126 may be a fire door which is usually unlocked, and may not even be preferred to be locked, i.e., may have to remain unlocked to comply with fire regulations. For example, the door 126 may be a swinging fire door configured to impede fire progression in the building 100, and may not have a lock installed thereon. However, for example, in a "Lock Down" situation, the ventilation system 112 may induce a differential air pressure on the two sides of the door 126 in the first zone 102 and the second zone 108 so as to keep the door 126 locked if needed. In this case, the pressure release device 110 may be used to the air pressure between the first zone 102 and the second zone 108 and override the access control functionality of the ventilation system 112 in case of a fire.

In some aspects, for example, the building 100 may be a house, and the door 126 may be a screen door or a storm door of the house.

In an aspect, the door 126 may need to be sufficiently sealed to maintain the differential air pressure induced by the ventilation system 112 on opposite sides of the door 126. Additionally, in an aspect, the first zone 102 and/or the second zone 108 may also need to be properly insulated/sealed to maintain the differential air pressure induced by the ventilation system 112 on the opposite sides of the door 126. In an aspect, the ventilation system 112 may need to provide sufficient air flow to maintain the differential air pressure to compensate for any leaks in the door 126, in the first zone 102, and/or in the second zone 108.

In an aspect, the door 126 may be installed/configured such that the door 126 swings in a direction that allows for achieving a "Lock Down" of the building 100 by inducing differential air pressure. For example, in an aspect, if multiple rooms belong to the first zone 102 neighboring a second zone 108 that includes the corridors, and such multiple rooms do not have separate air pressure controls, the doors of such multiple rooms may all be configured to swing similarly, e.g., they may all be configured to swing toward the corridors to close, or they may all be configured to swing away from the corridors to close.

In an alternative aspect, the controller 140 may first determine the swinging direction of the door 126 to close, and may then decide the polarity of the differential air pressure accordingly to either keep the door 126 closed or to assist in the opening of the door 126. For example, in an aspect, if the door 126 is configured to swing open toward the first zone 102 and away from the second zone 108 as illustrated in FIG. 1, the controller 140 may close the door 126 by causing the air pressure in the first zone 102 to be higher than the air pressure in the second zone 108. Alternatively, in an aspect, if the door 126 is configured to swing open toward the second zone 108 and away from the first zone 102, the controller 140 may close the door 126 by causing the air pressure in the first zone 102 to be lower than the air pressure in the second zone 108.

Figure 2:
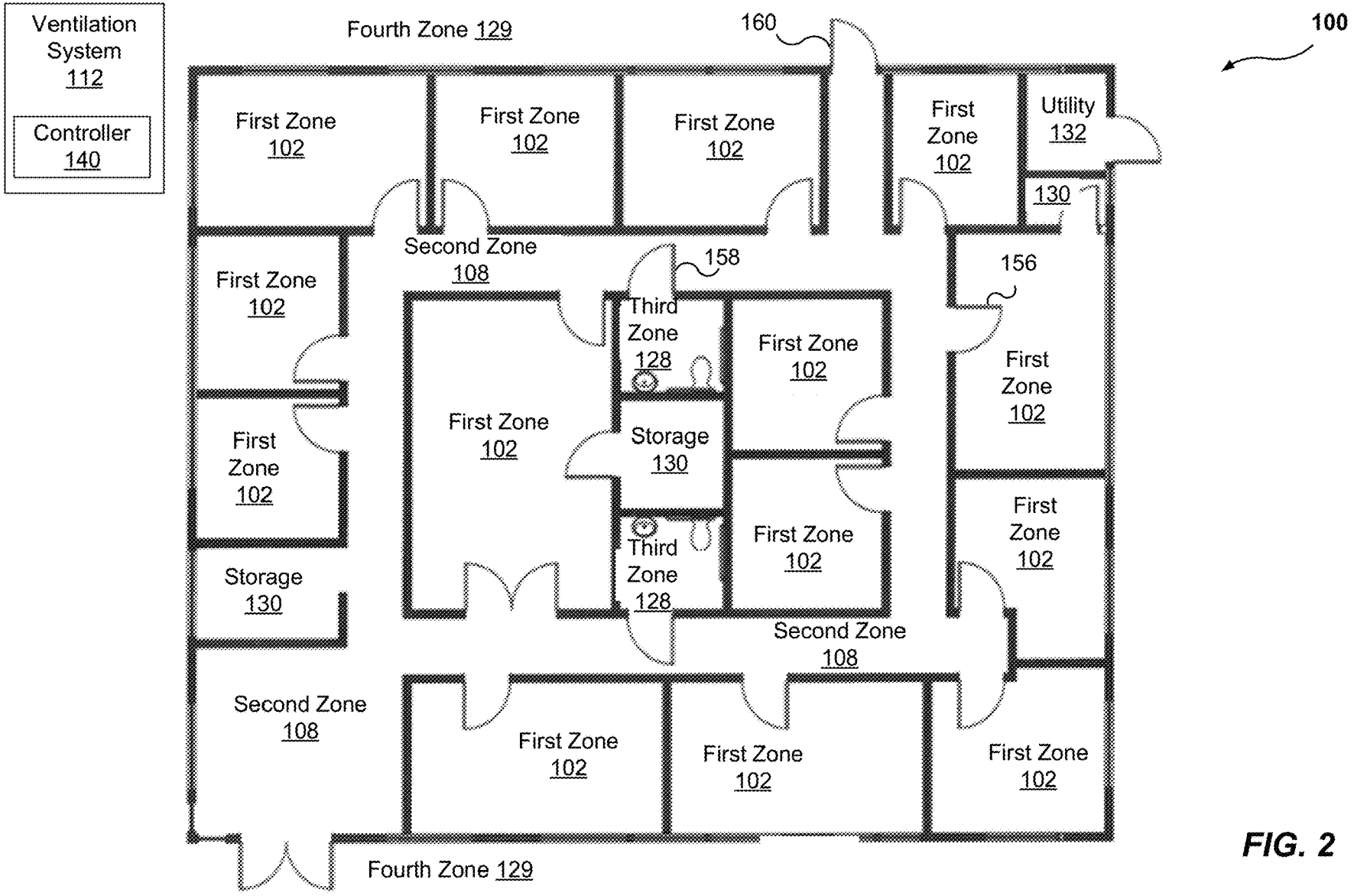
FIG. 2 is a schematic diagram of a second example access control system using differential air pressure.

Referring now to FIG. 2, in an aspect, for example, the building 100 may be an office building, the first zone 102 may include individual offices/rooms in the building 100, and the second zone 108 may include the corridors in the building 100. Further, a third zone 128 may include the bathrooms in the building 100, and a fourth zone 129 may correspond to the area outside the building 100. The building 100 may also include one or more storage areas 130 or utility rooms 132 that do not have or require access control functionality. In the example aspect of FIG. 2, office doors 156 are configured to open away from the corridors and toward the offices, i.e., to open away from the second zone 108 and toward the first zone 102. Further, bathroom doors 158 are configured to open away from the bathrooms and toward the corridors, i.e., to open away from the third zone 128 and toward the second zone 108. Further, main building doors 160 are configured to open away from the corridors and toward the outside of the building 100, i.e., to open away from the second zone 108 and toward the fourth zone 129. As such, the controller 140 of the ventilation system 112 may control only three air pressures corresponding to three zones, i.e., the first zone 102, the second zone 108, and the third zone 128, to lock every office/room door and every bathroom door to achieve a complete "Lock Down" state in the building 100.

Specifically, for example, if the outdoor ambient air pressure in the fourth zone 129 is measured or predicted or otherwise indicated to be about "14.7 PSI," the controller 140 may adjust the air pressure of the corridors in the second zone 108 to be "1/10 PSI" below the ambient air pressure, thus forcing the main building doors 160 to close toward the corridors in the second zone 108. Further, the controller 140 may adjust the air pressure of the bathrooms in the third zone 128 to be "1/10 PSI" below the air pressure of the corridors in the second zone 108, thus forcing the bathroom doors 158 to close toward the bathrooms in the third zone 128. Additionally, the controller 140 may adjust the air pressure of the offices/rooms in the first zone 102 to be "1/10 PSI" above the air pressure of the corridors in the second zone 108, thus forcing the office doors 156 to close toward the corridors in the second zone 108.

In an aspect, to unlock all the doors in the building 100, the controller 140 may normalize the air pressure in the first zone 102, the second zone 108, and the third zone 128 to be equal to the ambient air pressure in the fourth zone 129.

In an aspect, for example, each room in the building 100 may have its own separate zone, thus allowing for the ventilation system 112 to implement individual room door access control by inducing differential air pressure on opposite sides of each door, thus obviating the need for any door locks. In this aspect, each door may be opened by equalizing the air pressure on the two sides of that door.

In an aspect, for example, in a "Lock Down" situation, different rooms may have different "Lock Down" priorities according which a "Lock Down" may be implemented successively by the ventilation system 112. For example, in an aspect, the ventilation system 112 may first direct or otherwise control the air flow toward the areas with a higher "Lock Down" priority. After a "Lock Down" is achieved in such high priority areas, the ventilation system 112 may further direct or otherwise control the air flow toward the areas with a lower "Lock Down" priority. In an aspect, for example, there may be certain rooms in the building 100 that are of more concern, such as a plutonium area in a nuclear power plant as compared to a closet in the nuclear power plant, a money area in a casino as compared to the general areas in the casino, etc. In an aspect, one or more security equipment may also be used to supplement the priority information. For example, the priority of a room may be increased if a security camera identifies an asset in that room, such as a valuable object or person.

Accordingly, different priorities may be assigned to different zones/areas, and the air flow may be directed to high priority zones first, and then cascaded to other lower priority zones/areas. For example, the "Lock Down" may be controlled to be sequentially implemented, e.g., from a high priority or immediate danger area to lower priority or other adjacent areas. Hence, the sequential "Lock Down" effectively cascades through the different areas. For example, in an aspect, the ventilation system 112 may first create a vacuum or pressured condition in one area, and then walk back through subsequent neighboring areas to create a cascading access control effect in such areas. In an aspect, a distributed approach may be used to implement the cascaded access control mechanism by air flow. For example, in an aspect, in order to provide cascaded functionality that secures specific zones before other zones, the air handling duct ventilation controls may first divert full air flow to the highest priority zones and concentrate all ventilation air flow to such zones. After the desired differential air pressures have been established at the highest priority zones, the air flow may be diverted to the next highest priority zones, and so on.

In an aspect, the value of the differential air pressure needed to close or open the door 126 may be determined based on the surface area of the door 126. For example, the ventilation system 112 may induce a larger differential air pressure to open/close a small door as compared to a large door. Alternatively and/or additionally, the differential air pressure may also be determined based on whether there is another biasing force that keeps the door 126 open or closed. For example, if a mechanism such as a spring is biasing the door 126 against closing, the differential air pressure between the first zone 102 and the second zone 108 may be selected to be large enough to compensate for the biasing mechanism and result in a large enough closing force 142 to keep the door 126 closed/locked. Similarly, any leaks in the door 126, in the first zone 102, or in the second zone 108 may be compensated by choosing a higher differential air pressure between the first zone 102 and the second zone 108. Accordingly, in an aspect, each room may have a corresponding differential air pressure defined/selected thereto based on a door size, leaks, a door open/close biasing mechanism, etc.

In an aspect, a separate pressure sensor may be configured in each room of the building 100 to sense the air pressure in that room. In this case, the ventilation system 112 may use the measurements of the pressure sensors to adjust respective dampers 122 and/or fans 120 to maintain a certain air pressure in each room. Alternatively, in an aspect, a single pressure sensor may be installed per zone. For example, although the first zone 102 in FIG. 2 includes multiple rooms/offices, in an aspect, not every room/office may be equipped with a pressure sensor. Alternatively, in an aspect, for example, multiple pressure sensors may be installed in a single area. For example, in FIG. 2, multiple pressure sensors may be installed on opposite ends a hallway in the second zone 108.

In an aspect, the ventilation system 112 may implement energy efficiency functionality by controlling air flow based on whether a person has badged into an office space. For example, the ventilation system 112 may activate differential air pressure functionality for an office door only if a person has badged into the corresponding office. In an aspect, for example, an office door may open into the hallway so that when the person badges out of the office, the air conditioning can be shut down and the hallway air pressure can create a force to keep the door locked due to the differential air pressure on the two sides of the door.

In some aspects, pressure sensors may not be needed/used, and the air pressures on various zones may be controlled/adjusted based on selecting corresponding pre-determined air pressure values. For example, in an aspect, a fan speed, a damper control, etc., on one or both sides of a door may be adjusted based on pre-determined control values stored in a memory.

In an aspect, the ventilation system 112 may be configured to lock down only certain rooms in the building 100 upon determination of a "Lock Down" situation. For example, the ventilation system 112 may be configured to lock down only a vault, an executive office, etc., in the building 100. Accordingly, the ventilation system 112 may direct its entire power toward such rooms and thereby achieve a speedy "Lock Down."

In an aspect, the ventilation system 112 may be configured to apply different air flow adjustment profiles for pushing air into different areas of the building 100. For example, the ventilation system 112 may be configured to push less air into a small room and more air into larger rooms.

In an aspect, for example, in a "Lock Down" situation, the ventilation system 112 may be configured to adjust or determine the air flow based on how quickly the threat needs to be responded. For example, in an active shooter situation, the controller 140 may apply the maximum air flow possible to lock down the classrooms in a school.

The present aspects are also applicable to other closed spaces such as a car. For example, the ventilation system of a car may induce a higher air pressure inside the car as compared to the outside ambient air pressure, so as to assist in opening the car doors when the engine is turned off hence indicating that the driver is about to exit the car.

In an aspect, the ventilation system 112 may not receive any measurements from any pressure sensors and may instead deduce the air pressure in an area based on the horsepower applied to generate airflow in that area and the resulting air flow in that area.

In an aspect, for example, in a "Lock Down" situation, the controller 140 of the ventilation system 112 may determine that access control of a certain room/zone is lost, for example, by identifying that a desired differential air pressure is not achieved after a certain time of applying/controlling the air flow in that area. In this case, the controller 140 may cease trying to achieve the desired differential air pressure in that room/zone. In an aspect, for example, the controller 140 may try to achieve a differential air pressure for a while, and then give up if unsuccessful. This may happen, for example, if an active shooter fires into a door and causes the pressure on the two sides of the door to equalize. In an aspect, in the absence of security cameras in certain areas, loss of access control of rooms/areas may also be used to follow a progression of events.

Figure 3:
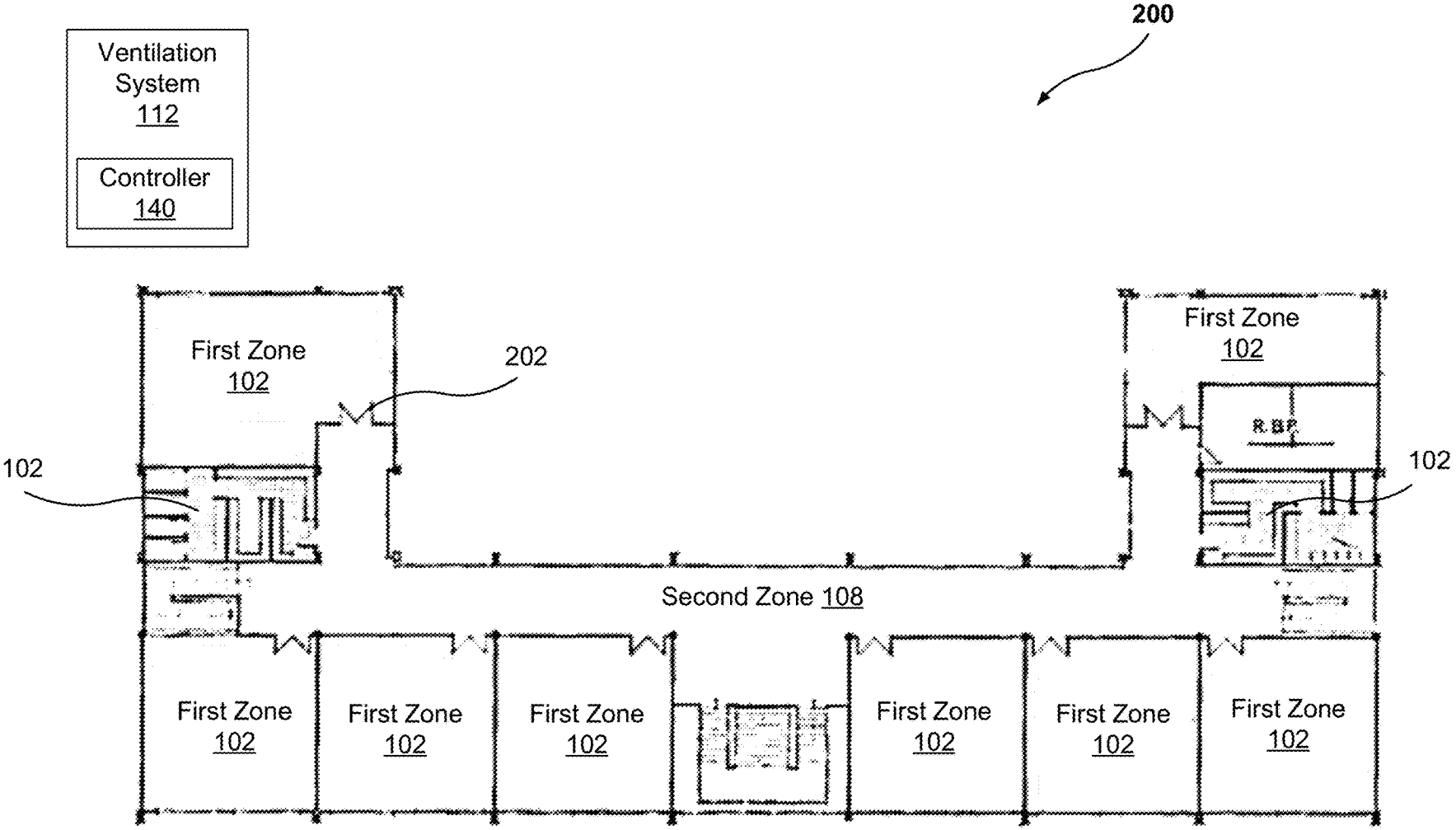
FIG. 3 is a schematic diagram of a third example access control system using differential air pressure.

Referring now to FIG. 3, for example, in an aspect, various areas of a school 200 may be divided into a first zone 102 and a second zone 108. For example, classrooms and bathrooms may belong to the first zone 102, while the corridors belong to the second zone 108. In an aspect, all of the classroom and bathroom doors 202 may be configured to close toward the corridors, i.e., toward the second zone 108, and away from respective classrooms/bathrooms, i.e., away from the first zone 102. Accordingly, the controller 140 of the ventilation system 112 may place the entire school 200 under a "Lock Down" by controlling only two air pressures corresponding to the first zone 102 and the second zone 108. For example, the controller 140 may increase the air pressure in all the areas belonging to the first zone 102 by "0.1 PSI" over the second zone 108, to lock all classroom/bathroom doors 202, thus placing the entire school floor under a "Lock Down."

Figure 4:
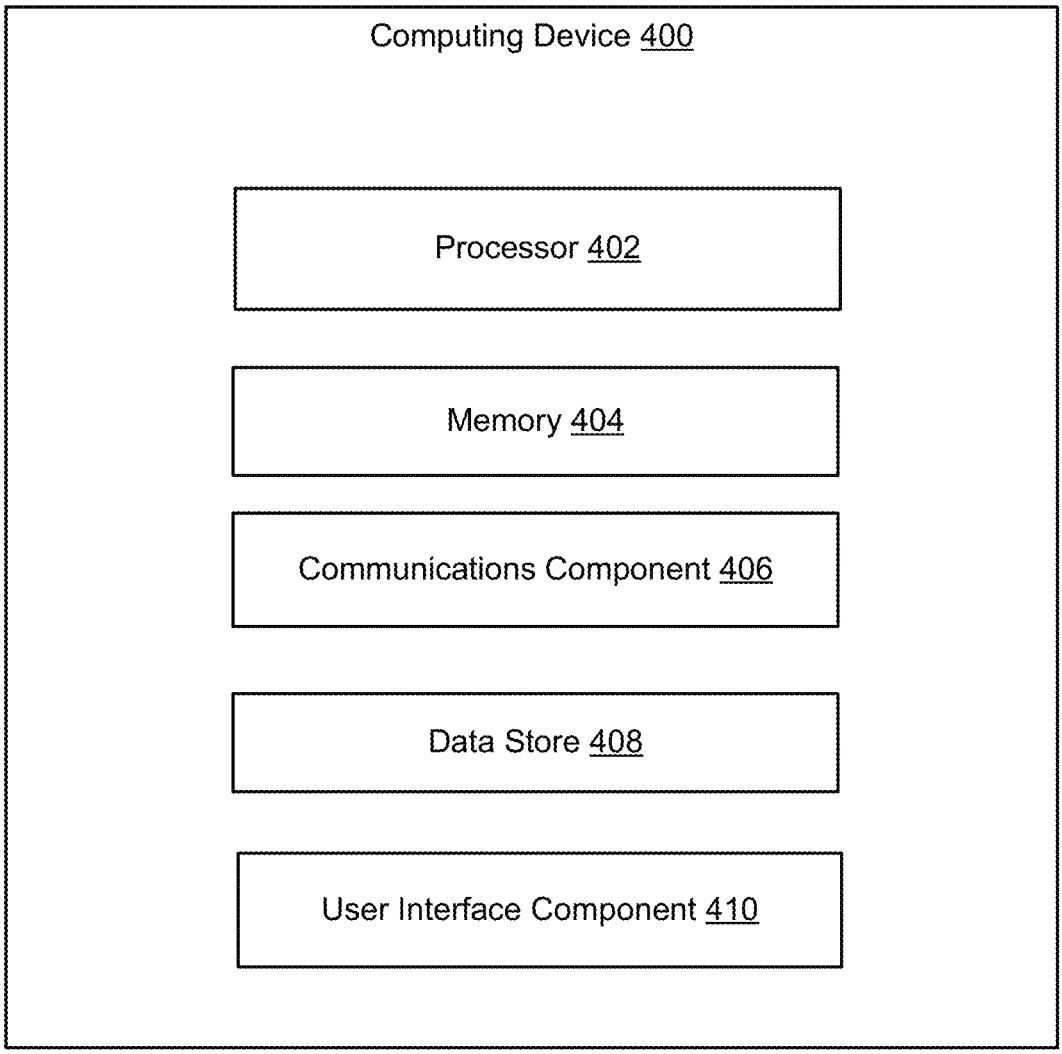
FIG. 4 is a block diagram of an example computing device which may implement the example access control system of any of FIGS. 1-3.

FIG. 4 illustrates an example block diagram providing details of computing components in a computing device 400 that may implement all or a portion of the functionality described in FIGS. 1-3 above or described in FIGS. 5-8 below. For example, the computing device 400 may be or may include at least a portion of the ventilation system 112, the access control system 114, the controller 140, the user interface 138, or any other component described herein with reference to FIGS. 1-3 above. The computing device 400 includes a processor 402 which may be configured to execute or implement software, hardware, and/or firmware modules that perform any functionality described herein with reference to FIGS. 1-3 above or with reference to FIGS. 5-8 below. For example, the processor 402 may be configured to execute or implement software, hardware, and/or firmware modules that perform any functionality described herein with reference to the ventilation system 112, the access control system 114, the controller 140, the user interface 138, or any other component/system/device described herein with reference to FIGS. 1-3.

The processor 402 may be a micro-controller, an application-specific integrated circuit (ASIC), or a field-programmable gate array (FPGA), and/or may include a single or multiple set of processors or multi-core processors. Moreover, the processor 402 may be implemented as an integrated processing system and/or a distributed processing system. The computing device 400 may further include a memory 404, such as for storing local versions of applications being executed by the processor 402, related instructions, parameters, etc. The memory 404 may include a type of memory usable by a computer, such as random access memory (RAM), read only memory (ROM), tapes, magnetic discs, optical discs, volatile memory, non-volatile memory, and any combination thereof. Additionally, the processor 402 and the memory 404 may include and execute an operating system executing on the processor 402, one or more applications, display drivers, etc., and/or other components of the computing device 400.

Further, the computing device 400 may include a communications component 406 that provides for establishing and maintaining communications with one or more other devices, parties, entities, etc. utilizing hardware, software, and services. The communications component 406 may carry communications between components on the computing device 400, as well as between the computing device 400 and external devices, such as devices located across a communications network and/or devices serially or locally connected to the computing device 400. For example, the computing device 400 may implement the ventilation system 112 in FIG. 1, in which case the communications component 406 may provide for establishing and maintaining communications with the access control system 114, with the first pressure sensor 104, and/or with the second pressure sensor 106. Similarly, the computing device 400 may implement the pressure sensors 104 and 106 in FIG. 1, in which case the communications component 406 may provide for establishing and maintaining communications with the ventilation system 112. Also, the computing device 400 may implement the access control system 114 in FIG. 1, in which case the communications component 406 may provide for establishing and maintaining communications with the ventilation system 112. Further, the computing device 400 may implement a user interface 138 located in the first zone 102 or in the second zone 108 in FIG. 1, in which case the communications component 406 may provide for establishing and maintaining communications with the ventilation system 112 and/or with the access control system 114.

In an aspect, for example, the communications component 406 may include one or more buses, and may further include transmit chain components and receive chain components associated with a wireless or wired transmitter and receiver, respectively, operable for interfacing with external devices.

Additionally, the computing device 400 may include a data store 408, which can be any suitable combination of hardware and/or software that provides for mass storage of information, databases, and programs. For example, the data store 408 may be or may include a data repository for applications and/or related parameters not currently being executed by processor 402. In addition, the data store 408 may be a data repository for an operating system, application, display driver, etc., executing on the processor 402, and/or one or more other components of the computing device 400.

The computing device 400 may also include a user interface component 410 that includes or implements the functionality of the user interface 138 as described herein with reference to FIG. 1. For example, the user interface component 410 may be operable to receive inputs from a user of the computing device 400 and further operable to generate outputs for presentation to the user (e.g., via a display interface to a display device). The user interface component 410 may include one or more input devices, including but not limited to a keyboard, a number pad, a mouse, a touch-sensitive display, a navigation key, a function key, a microphone, a voice recognition component, or any other mechanism capable of receiving an input from a user, or any combination thereof. Further, the user interface component 410 may include one or more output devices, including but not limited to a display interface, a speaker, a haptic feedback mechanism, a printer, any other mechanism capable of presenting an output to a user, or any combination thereof.

FIGS. 5-8 are flowcharts of methods 500, 600, 700, and 800 of operation of the computing device 400. Each of the methods 500, 600, 700, and 800 may implement the functionality described herein with reference to FIGS. 1-4, and may be performed by one or more components of the computing device 400 as described herein with reference to FIGS. 1-4 above. As such, in the following, the methods 500, 600, 700, and 800 are described with reference to various components illustrated in FIGS. 1-4.

Figure 5:
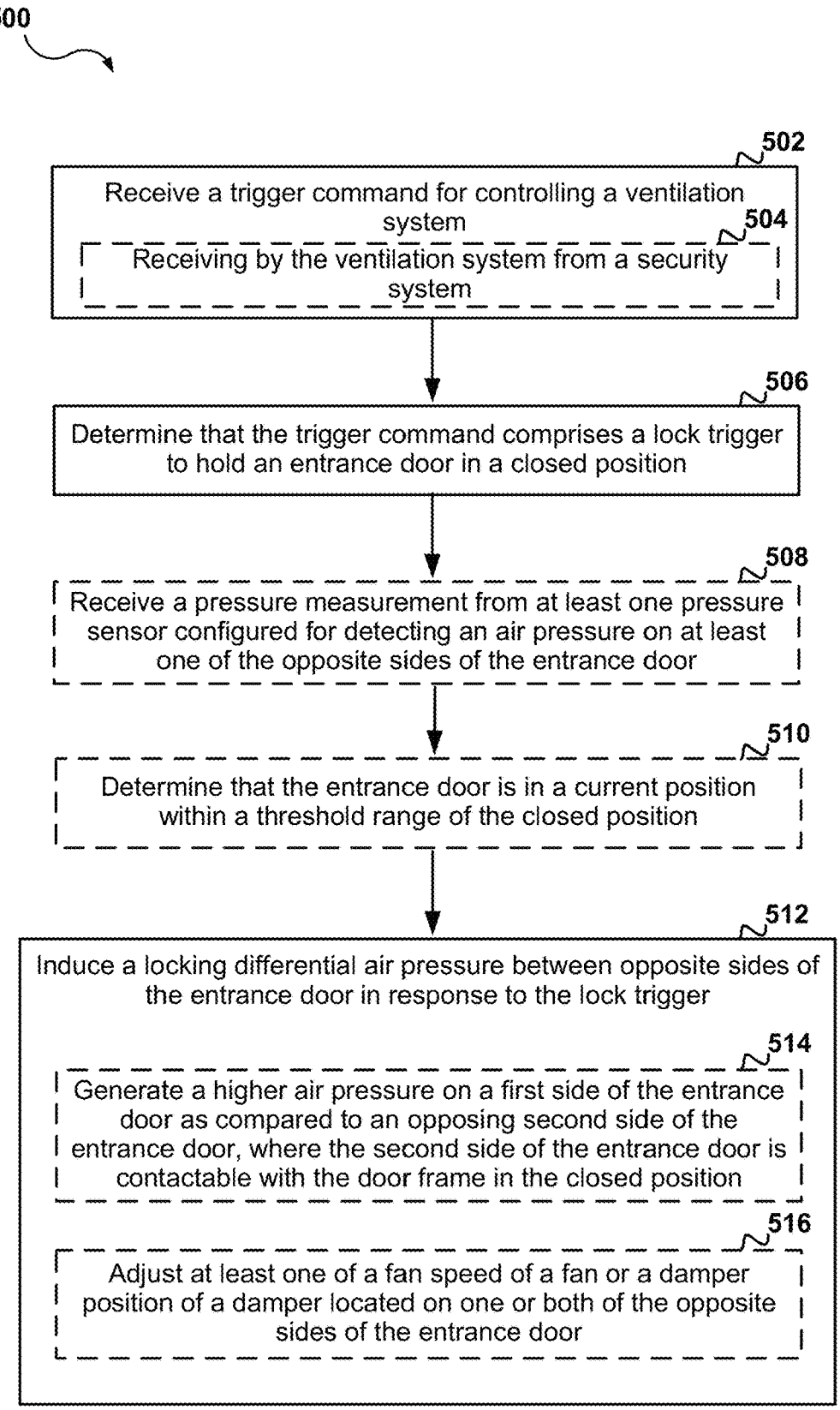
FIG. 5 is a flow diagram of a first example access control method.

Referring to FIG. 5, at 502 the method 500 includes receiving a trigger command for controlling a ventilation system. For example, in an aspect, the controller 140 in the ventilation system 112 may receive the trigger signal 118 for access control functionality. Optionally, in an aspect, the block 502 may include the block 504, and at 504 the method 500 may further include receiving by the ventilation system from a security system. For example, in an aspect, the ventilation system 112 may receive the trigger signal 118 from the access control system 114.

At 506 the method 500 may further include determining that the trigger command comprises a lock trigger to hold an entrance door in a closed position. For example, in an aspect, the controller 140 may determine that the trigger signal 118 is a lock trigger to hold the entrance door 126 in a closed position 150.

Optionally, at 508 the method 500 may further include receiving a pressure measurement from at least one pressure sensor configured for detecting an air pressure on at least one of the opposite sides of the entrance door. For example, in an aspect, the ventilation system 112 may receive one or more pressure measurements 116 from at least one pressure sensor configured for detecting an air pressure on at least one of the opposite sides of the entrance door 126, such as the first pressure sensor 104 in the first zone 102 or the second pressure sensor 106 in the second zone 108.

Optionally, at 510 the method 500 may further include determining that the entrance door is in a current position within a threshold range of the closed position. For example, in an aspect, the controller 140 may determine whether the entrance door 126 is in a current position within a threshold range of the closed position, e.g., whether the entrance door 126 is in the closed position 150 or in the at least substantially closed position 152. In an aspect, such determination may be performed, for example, based on signals from a proximity sensor.

At 512 the method 500 may further include inducing a locking differential air pressure between opposite sides of the entrance door in response to the lock trigger, where the locking differential air pressure is sufficient to bias the entrance door to contact or to increase contact with a door frame in the closed position. For example, in an aspect, the controller 140 may control the ventilation system 112 to induce a locking differential air pressure between opposite sides of the entrance door 126 in response to the lock trigger signal 118, where the locking differential air pressure is sufficient to bias the entrance door 126 to contact or to increase contact with the door frame 127 in the closed position 150.

Optionally, in an aspect, the inducing of the locking differential air pressure is further in response to the pressure measurements 116.

Optionally, in an aspect, the inducing of the locking differential air pressure is further in response to the entrance door 126 being within the threshold range of the closed position 150.

Optionally, in an aspect, the locking differential air pressure is sufficient to generate a target contact force between the entrance door 126 and the door frame 127.

Optionally, in an aspect, the block 512 may include the block 514, and at block 514 the method 500 may further include generating a higher air pressure on a first side of the entrance door as compared to an opposing second side of the entrance door, where the second side of the entrance door is contactable with the door frame in the closed position. For example, in an aspect, the controller 140 may cause the ventilation system 112 to generate a higher air pressure on a first side of the entrance door 126, e.g., the side facing the first zone 102, as compared to an opposing second side of the entrance door 126, e.g., the side facing the second zone 108, where the second side of the entrance door 126 is contactable with the door frame 127 in the closed position 150.

Optionally, in an aspect, the entrance door 126 may be swingable about the axis 148 in a direction toward the second side of the entrance door, e.g., the side facing the second zone 108, to move from an open position to the closed position 150.

Optionally, in an aspect, the entrance door 126 may be linearly movable, e.g., slideable, from an open position to the closed position 150.

Optionally, in an aspect, the block 512 may include the block 516, and at block 516 the method 500 may further include adjusting at least one of a fan speed of a fan or a damper position of a damper located on one or both of the opposite sides of the entrance door. For example, in an aspect, the controller 140 may control the ventilation system 112 to adjust at least one of a fan speed of a fan 120 or a damper position of a damper 122 located on one or both of the opposite sides of the entrance door, located in the first zone 102 or in the second zone 108.

Figure 6:
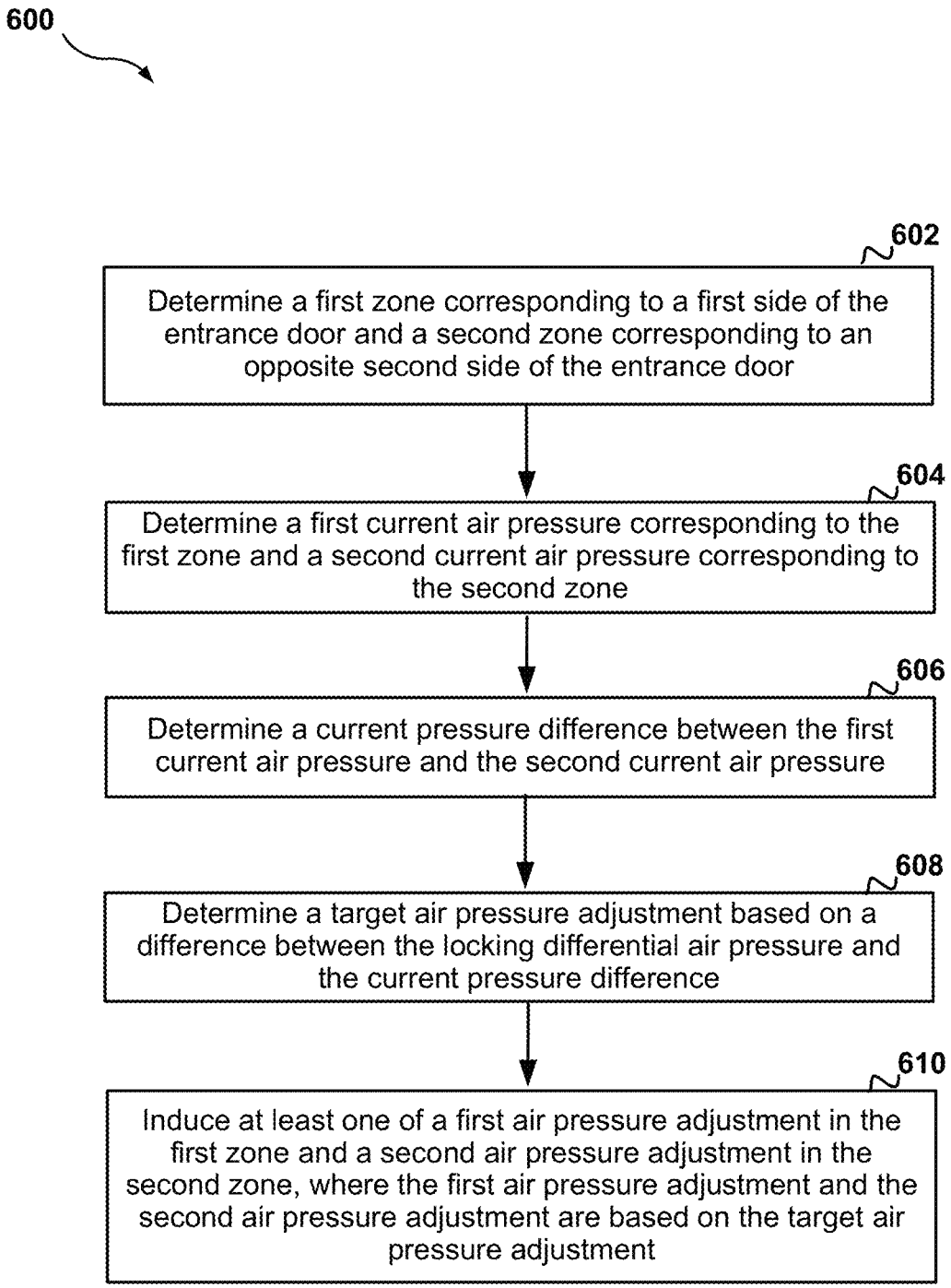
FIG. 6 is a flow diagram of a second example access control method.

Referring to FIG. 6, the method 600 may optionally be performed in addition to or in conjunction with the method 500 for access control.

At block 602 the method 600 includes determining a first zone corresponding to a first side of the entrance door and a second zone corresponding to an opposite second side of the entrance door. For example, in an aspect, after receiving the trigger signal 118, the controller 140 may determine a first zone 102 corresponding to a first side of the entrance door 126 and a second zone 108 corresponding to an opposite second side of the entrance door 126.

At block 604 the method 600 may further include determining a first current air pressure corresponding to the first zone and a second current air pressure corresponding to the second zone. For example, in an aspect, the controller 140 may receive the pressure measurements 116 from the first pressure sensor 104 in the first zone 102 and the second pressure sensor 106 in the second zone 108, and determine a first current air pressure corresponding to the first zone 102 and a second current air pressure corresponding to the second zone 108 accordingly.

At block 606 the method 600 may include determining a current pressure difference between the first current air pressure and the second current air pressure. For example, in an aspect, the controller 140 may use the current air pressure in the first zone 102 and in the second zone 108 to determine a current pressure difference.

At block 608 the method 600 may include determining a target air pressure adjustment based on a difference between the locking differential air pressure and the current pressure difference. For example, in an aspect, the controller 140 may determine a target air pressure adjustment based on a difference between the locking differential air pressure and the current pressure difference.

At block 610 the method 600 may further include inducing at least one of a first air pressure adjustment in the first zone and a second air pressure adjustment in the second zone, where the first air pressure adjustment and the second air pressure adjustment are based on the target air pressure adjustment. For example, in an aspect, the controller 140 may control the ventilation system 112 to induce at least one of a first air pressure adjustment in the first zone 102 and a second air pressure adjustment in the second zone 107, where the first air pressure adjustment and the second air pressure adjustment are based on the target air pressure adjustment.

Figure 7:
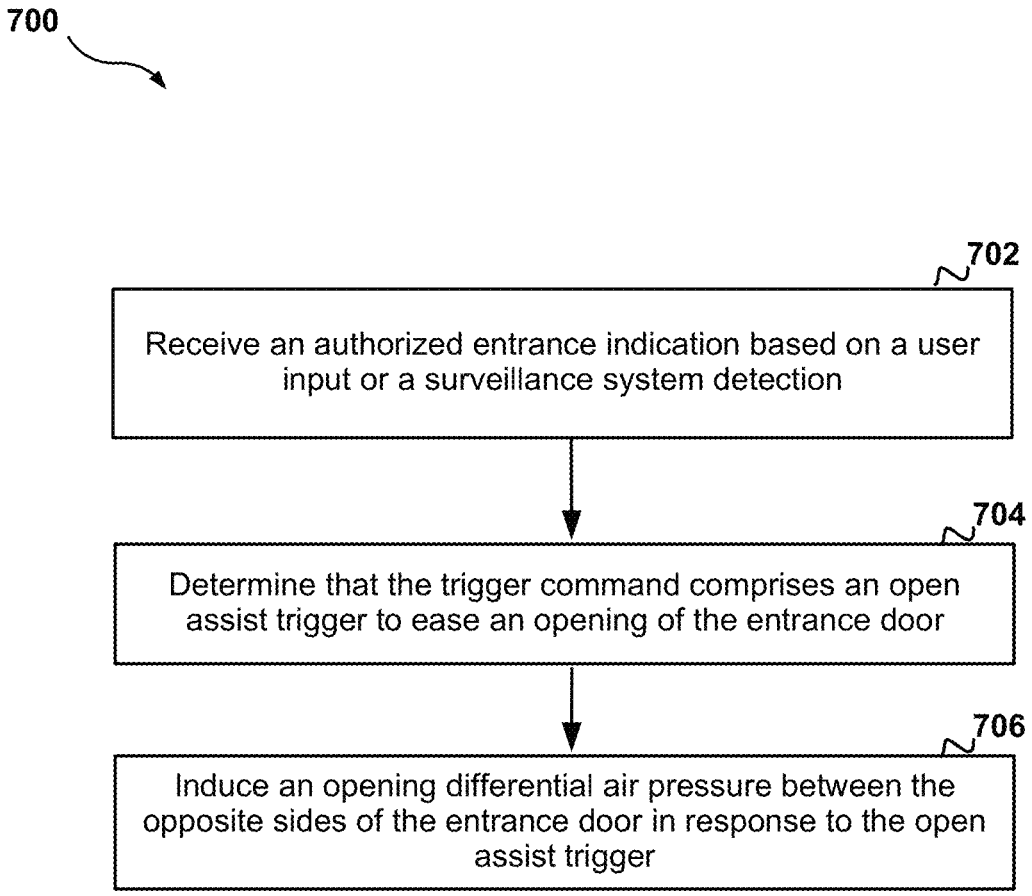
FIG. 7 is a flow diagram of a third example access control method.

Referring to FIG. 7, the method 700 may optionally be performed in addition to or in conjunction with the method 500 for access control.

At 702 the method 700 includes receiving an authorized entrance indication based on a user input or a surveillance system detection. For example, in an aspect, the access control system 114 may receive or generate the "legitimate entrance attempt indication" based on a user input provided by the user 124 through a user interface 138 or based on detecting the user 124 by the access control system 114, e.g., via security cameras.

At 704 the method 700 may further include determining that the trigger command comprises an open assist trigger to ease an opening of the entrance door. For example, after validating that the user 124 is legitimate, the access control system 114 may use the user input to determine that the trigger command comprises an open assist trigger to ease an opening of the entrance door 126.

At 706 the method 700 may further include inducing an opening differential air pressure between the opposite sides of the entrance door in response to the open assist trigger, where the opening differential air pressure is sufficient to bias the entrance door to reduce contact with the door frame in the closed position. For example, in an aspect, the controller 140 may cause the ventilation system 112 to induce an opening differential air pressure between the opposite sides of the entrance door 126 in response to the open assist trigger signal 118, where the opening differential air pressure is sufficient to bias the entrance door 126 to reduce contact with the door frame 127 in the closed position 150.

Optionally, in an aspect, the determining of the open assist trigger may be based on the authorized entrance indication.

Figure 8:
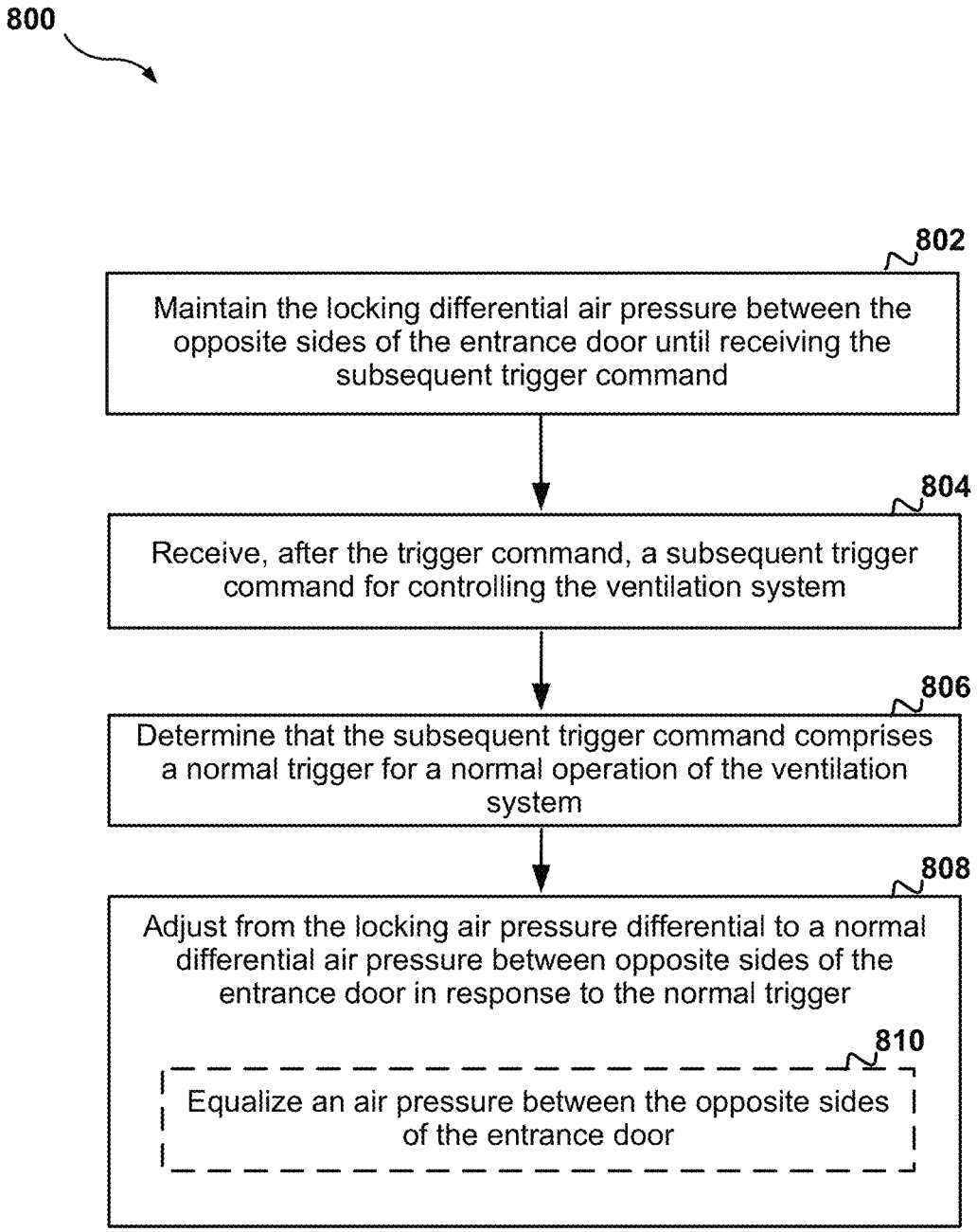
FIG. 8 is a flow diagram of a fourth example access control method.

Referring to FIG. 8, the method 800 may optionally be performed subsequent to the method 500 for access control.

At 802 the method 800 may include maintaining the locking differential air pressure between the opposite sides of the entrance door until receiving the subsequent trigger command. For example, in an aspect, after inducing the locking differential air pressure, the controller 140 may continue to control the ventilation system 112 to maintain the locking differential air pressure between the opposite sides of the entrance door 126 until receiving a subsequent trigger command.

At 804 the method 800 may further include receiving, after the trigger command, a subsequent trigger command for controlling the ventilation system. For example, in an aspect, subsequent to receiving the trigger command that caused the inducing of the locking differential air pressure, the controller 140 may receive a subsequent trigger command for controlling the ventilation system 112.

At 806 the method 800 may further include determining that the subsequent trigger command comprises a normal trigger for a normal operation of the ventilation system. For example, in an aspect, the controller 140 may determine that the subsequent trigger command is a normal trigger signal 118 for a normal mode of operation of the ventilation system 112.

At 810 the method 800 may further include adjusting from the locking air pressure differential to a normal differential air pressure between opposite sides of the entrance door in response to the normal trigger. For example, in an aspect, the controller 140 may control the ventilation system 112 to adjust from the locking air pressure differential to a normal differential air pressure between opposite sides of the entrance door 126 in response to the normal trigger.

Optionally, the block 808 may include the block 810, and at block 810 the method 800 may further include equalizing an air pressure between the opposite sides of the entrance door. For example, in an aspect, the controller 140 may control the ventilation system 112 to equalize the air pressure between the opposite sides of the entrance door 126.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. An access control method, comprising:

receiving a trigger command for controlling a ventilation system;

determining that the trigger command comprises a lock trigger to hold an entrance door in a closed position, wherein the entrance door is swingable about an axis;

determining a swinging direction of the entrance door for closing the entrance door in response to the lock trigger;

determining, based on the swinging direction, a polarity for a locking differential air pressure between opposite sides of the entrance door for closing the entrance door; and inducing the locking differential air pressure between the opposite sides of the entrance door in response to the lock trigger, wherein the locking differential air pressure is sufficient to bias the entrance door to contact or to increase contact with a door frame in the closed position.

2. The access control method of claim 1, wherein the locking differential air pressure is sufficient to generate a contact force between the entrance door and the door frame.

3. The access control method of claim 1, wherein the inducing of the locking differential air pressure comprises generating a higher air pressure on a first side of the entrance door as compared to an opposing second side of the entrance door, wherein the opposing second side of the entrance door is contactable with the door frame in the closed position.

4. The access control method of claim 3, wherein the entrance door is swingable about the axis in the swinging direction toward the opposing second side of the entrance door to move from an open position to the closed position.

5. The access control method of claim 1, further comprising:

receiving a pressure measurement from at least one pressure sensor configured for detecting an air pressure on at least one of the opposite sides of the entrance door; and wherein the inducing of the locking differential air pressure is further in response to the pressure measurement.

6. The access control method of claim 1, further comprising:

determining a first zone corresponding to a first side of the entrance door and a second zone corresponding to an opposite second side of the entrance door;

determining a first current air pressure corresponding to the first zone and a second current air pressure corresponding to the second zone;

determining a current pressure difference between the first current air pressure and the second current air pressure;

determining a target air pressure adjustment based on a difference between the locking differential air pressure and the current pressure difference; and wherein the inducing of the locking differential air pressure comprises inducing at least one of a first air pressure adjustment in the first zone and a second air pressure adjustment in the second zone, wherein the first air pressure adjustment and the second air pressure adjustment are based on the target air pressure adjustment.

7. The access control method of claim 1, wherein the inducing of the locking differential air pressure comprises adjusting at least one of a fan speed of a fan or a damper position of a damper located on one or both of the opposite sides of the entrance door.

8. The access control method of claim 1, further comprising:

determining that the entrance door is in a current position within a threshold range of the closed position; and wherein the inducing of the locking differential air pressure is further in response to the entrance door being within the threshold range of the closed position.

9. The access control method of claim 1, further comprising:

determining that the trigger command comprises an open assist trigger to ease an opening of the entrance door; and inducing an opening differential air pressure between the opposite sides of the entrance door in response to the open assist trigger, wherein the opening differential air pressure is sufficient to bias the entrance door to reduce contact with the door frame in the closed position.

10. The access control method of claim 9, further comprising:

receiving an authorized entrance indication based on a user input or a surveillance system detection; and wherein the determining of the open assist trigger is based on the authorized entrance indication.

11. The access control method of claim 1, further comprising:

receiving, after the trigger command, a subsequent trigger command for controlling the ventilation system;

determining that the subsequent trigger command comprises a normal trigger for a normal operation of the ventilation system; and adjusting from the locking differential air pressure to a normal differential air pressure between the opposite sides of the entrance door in response to the normal trigger.

12. The access control method of claim 11, further comprising:

maintaining the locking differential air pressure between the opposite sides of the entrance door until receiving the subsequent trigger command.

13. The access control method of claim 11, wherein the adjusting from the locking differential air pressure to the normal differential air pressure comprises equalizing an air pressure between the opposite sides of the entrance door.

14. The access control method of claim 1, wherein the receiving of the trigger command comprises receiving by the ventilation system from a security system.

15. An apparatus for access control, comprising:

a memory comprising instructions; and a processor in communication with the memory and configured to execute the instructions to:

receive a trigger command for controlling a ventilation system;

determine that the trigger command comprises a lock trigger to hold an entrance door in a closed position, wherein the entrance door is swingable about an axis;

determine a swinging direction of the entrance door for closing the entrance door in response to the lock trigger;

determine, based on the swinging direction, a polarity for a locking differential air pressure between opposite sides of the entrance door for closing the entrance door; and induce the locking differential air pressure between the opposite sides of the entrance door in response to the lock trigger, wherein the locking differential air pressure is sufficient to bias the entrance door to contact or to increase contact with a door frame in the closed position.

16. The apparatus of claim 15, wherein the locking differential air pressure is sufficient to generate a contact force between the entrance door and the door frame.

17. The apparatus of claim 15, wherein the apparatus induces the locking differential air pressure by generating a higher air pressure on a first side of the entrance door as compared to an opposing second side of the entrance door, wherein the opposing second side of the entrance door is contactable with the door frame in the closed position.

18. The apparatus of claim 17, wherein the entrance door is swingable about the axis in the swinging direction toward the opposing second side of the entrance door to move from an open position to the closed position.

19. A non-transitory computer-readable medium storing instructions that, when executed by a processor, cause the processor to:

receive a trigger command for controlling a ventilation system;

determine that the trigger command comprises a lock trigger to hold an entrance door in a closed position, wherein the entrance door is swingable about an axis;

determine a swinging direction of the entrance door for closing the entrance door in response to the lock trigger;

determine, based on the swinging direction, a polarity for a locking differential air pressure between opposite sides of the entrance door for closing the entrance door; and induce the locking differential air pressure between the opposite sides of the entrance door in response to the lock trigger, wherein the locking differential air pressure is sufficient to bias the entrance door to contact or to increase contact with a door frame in the closed position.

* * * * *